US006018935A

United States Patent [19]

Perrone

[11] Patent Number: 6,018,935

[45] Date of Patent: Feb. 1, 2000

[54] MACHINE FOR ENROBING TABLETS WITH GELATIN

[76] Inventor: Aldo Perrone, 7 Blue Jay Crescent, Brampton, Ontario, Canada, L6T 3Z8

[21] Appl. No.: 09/059,144

[22] Filed: Apr. 13, 1998

[51] Int. Cl.[7] ..... B65B 47/02

[52] U.S. Cl. ..... 53/560; 53/454

[58] Field of Search ..... 53/900, 560, 559, 53/454, 453

[56] References Cited

U.S. PATENT DOCUMENTS

| | | | |
|---|---|---|---|
| 2,296,294 | 9/1942 | Scherer | 18/21 |
| 2,323,581 | 7/1943 | Weckesser | 18/21 |
| 2,387,747 | 10/1945 | Cowley | 18/21 |
| 2,608,405 | 8/1952 | Salfisberg et al. | 271/2.3 |
| 2,697,317 | 12/1954 | Stirn et al. | 53/89.5 |
| 2,775,080 | 12/1956 | Stirn et al. | 53/26 |
| 4,567,714 | 2/1986 | Chasman | 53/438 |
| 4,970,888 | 11/1990 | Shiraishi et al. | 72/405 |
| 5,074,102 | 12/1991 | Simpson et al. | 53/454 |
| 5,146,730 | 9/1992 | Sadek et al. | 53/454 |
| 5,436,026 | 7/1995 | Berta | 427/2.14 |
| 5,459,983 | 10/1995 | Sadek et al. | 53/560 |
| 5,498,441 | 3/1996 | Berta | 427/2.14 |
| 5,503,673 | 4/1996 | Berta | 118/16 |
| 5,538,125 | 7/1996 | Berta | 198/345.3 |
| 5,607,044 | 3/1997 | Berta | 198/468.4 |
| 5,679,406 | 10/1997 | Berta | 427/289 |
| 5,682,733 | 11/1997 | Perrone | 53/560 |

FOREIGN PATENT DOCUMENTS 535783 1/1957 Canada .

*Primary Examiner*—Joseph J. Hail, III
*Assistant Examiner*—Dermott J. Cooke
*Attorney, Agent, or Firm*—Barry R. Lipsitz; Ralph F. Hoppin

[57] ABSTRACT

An apparatus for enrobing tablets in a gelatin layer includes a pair of die assemblies with each assembly including a rotatable, cylindrical die support and a series of die blocks mounted on this support for movement along a circular path. Each block has recesses formed in a top surface thereof and each recess of one assembly cooperates with a similar recess in the other assembly to form a cavity at a nip formed by the two assemblies. Each cavity is dimensioned to receive loosely therein one of the tablets. Two casting drums deliver gelatin strips to the die assemblies and each strip is pulled by one assembly into the nip. A time tablet dispensing mechanism is used to dispense tablets onto one of the strips at a feeding location. The preferred die blocks are made of hard plastics material. The tablet dispensing mechanism employs vacuum applying members operatively connected to a vacuum source and air cylinder transfer mechanisms for moving these members from a tablet pick-up position to the feeding location.

13 Claims, 10 Drawing Sheets

MACHINE FOR ENROBING TABLETS WITH GELATIN

BACKGROUND OF THE INVENTION

This invention relates to an apparatus for enrobing medicine and other ingestible tablets in a digestible film.

The pharmaceutical industry commonly provides drugs in the form of a capsule or tablet that can be readily swallowed by a person. The dosage form known as a tablet is solid and hard with a predetermined shape. Its active ingredients are held together with a suitable binder.

Recent U.S. Pat. No. 5,146,730 issued Sep. 15, 1992 to Banner Gelatin Products Corp. teaches a method and apparatus for producing medicine tablets that are enrobed in a gelatin coating formed by applying two layers of film to opposite sides of the tablet. Hard cores or preforms are dispensed on a self-timed basis into simultaneous contact with the two films which are supported on coacting rotary dies that come together to form a nip. The hard cores contact the films adjacent this nip at places which overlay recesses formed in the dies. The elastic films deform around each core and are sealed by the dies to each other. The dies then cut the covered cores from the films.

One of the difficulties of this known apparatus is that the rotary die members which are believed to be made of metal are quite expensive to manufacture. If one or both of the rotary dies should be damaged for any reason, it may be necessary to completely replace one or both of the rotary die members at a substantial cost. Furthermore, if this should occur and it becomes necessary to shut down a manufacturing operation until the one or more rotary dies are replaced, there is likely to be substantial additional expense and loss as a result of the shutdown in operations.

Recent U.S. Pat. No. 5,682,733 issued Nov. 4, 1997 to the present applicant describes another apparatus for enrobing tablets, which apparatus employs a main linked track of die blocks with each block having a number of recesses formed in its top surface. There is also a revolving cooperating die device which can be either another linked track or a cylindrical rotary die and this device also has a plurality of recesses, each of which is cooperable with a recess of similar size in the main linked track to provide an enclosed cavity capable of holding one of the tablets. A gelatin strip is delivered to the main linked track and moves along its upper path. A tablet dispenser drops tablets into depressions formed in this gelatin strip. A second gelatin strip is delivered to the apparatus and is laid over the first strip when the two strips reach a region of contact.

It is an object of the present invention to provide an apparatus for enrobing tablets in a layer of gelatin, which apparatus employs rotary die assemblies each with a series of die blocks and which apparatus can be repaired should it become damaged with reasonable speed and at less expense than the prior art rotary die members.

It is another object of the present invention to provide relatively inexpensive die blocks for use in an apparatus for enrobing ingestible tablets, these blocks being made of a hard plastics material and each having a number of similar recesses formed in the top.

It is a further object of the present invention to provide an apparatus for enrobing tablets in a gelatin layer which employs a novel timed tablet dispensing mechanism having one or more vacuum applying members operatively connectible to a vacuum source and a transfer mechanism for moving one or more of these members from a tablet pick-up position to a feeding location.

SUMMARY OF THE INVENTION

According to one aspect of the invention, an apparatus for enrobing tablets in a gelatin layer includes a pair of cylindrical rotary die assemblies, each die assembly including a substantially cylindrical, rotatable die support and a series of die blocks mounted on the die support for rotation about a central axis of the die support. Each block has at least one recess formed in a top surface thereof and each recess of each die assembly is cooperable with a similar recess in the other die assembly to form a cavity at a nip formed by the die assemblies. Each cavity is dimensioned to receive loosely therein one of the tablets. The apparatus also includes a drive system for rotating both die assemblies around their respective central axes so that the two series move in synchronism with each other. Feed apparatus delivers a gelatin strip of selected thickness and composition to each of the die assemblies. During use of the apparatus, each gelatin strip is pulled by a respective one of the die assemblies into the nip and is laid on a section of the series of die blocks of the respective die assembly. A timed tablet dispensing mechanism dispenses individual whole tablets onto one of the gelatin strips at a feeding location that is upstream of the nip. Each dispensed tablet moves with the one gelatin strip into the nip and portions of both gelatin strips are stretched about the dispensed tablet in a respective one of the cavities so that the tablet is enrobed by the portions of both strips.

In a preferred embodiment, each die block of each series has a number of recesses arranged in one or more rows extending transversely of its respective die assembly and is made of a hard, plastics material.

According to another aspect of the invention, a die block for use in an apparatus for enrobing ingestible tablets of selected size and shape with a gelatin film has a top, a bottom and sides extending between the top and the bottom. There are a number of similar recesses formed in the top with each recess being dimensioned to receive loosely therein at least one half of one of the tablets. A raised rim extends about a perimeter of each recess for cutting a gelatin film laid over the top of the block during use of the block, which is made of hard, plastics material.

In a particularly preferred embodiment, the block is made of carbon fibre reinforced plastics material.

According to a further aspect of the invention, an apparatus for enrobing tablets in a gelatin layer includes a pair of cylindrical, rotary die assemblies having coacting working surfaces which meet at an assembly nip. Each die assembly has a number of recesses formed in its working surface along a circumferential line and each recess is cooperable with a similar recess in the other die assembly to form at the assembly nip a cavity dimensioned to receive loosely therein one of the tablets. The apparatus further includes a drive system for rotating the die assemblies so that these die assemblies move in synchronism with each other and feed mechanisms for delivering two gelatin strips to the die assemblies whereby, during use of the apparatus, the gelatin strips are pulled by the die assemblies into the nip. A timed tablet dispensing mechanism is provided for dispensing individual tablets onto one of the gelatin strips at a feeding location upstream from the assembly nip. This one gelatin strip is supported by the working surface of one of the die assemblies at the feeding location. The tablet dispensing mechanism includes at least one vacuum applying member operatively connected to a vacuum source and a transfer mechanism for moving the at least one vacuum applying member from a tablet pick-up position to the feeding location where, during use of the apparatus, at least one tablet is released by the vacuum applying member onto the one gelatin strip. The operation of the tablet dispensing mechanism is synchronized with rotation of the die assemblies so that each tablet is released over a respective one of the recesses of the one die assembly.

Preferably the tablet dispensing mechanism comprises a number of vacuum applying members arranged in a row extending transversely of the one die assembly and the transfer mechanism includes a slidable frame member on which the vacuum applying members are mounted.

Further features and advantages will become apparent from the following detailed description taken in conjunction with the accompanying drawings.

DETAILED DESCRIPTION OF PREFERRED EMBODIMENT

Figure 1:
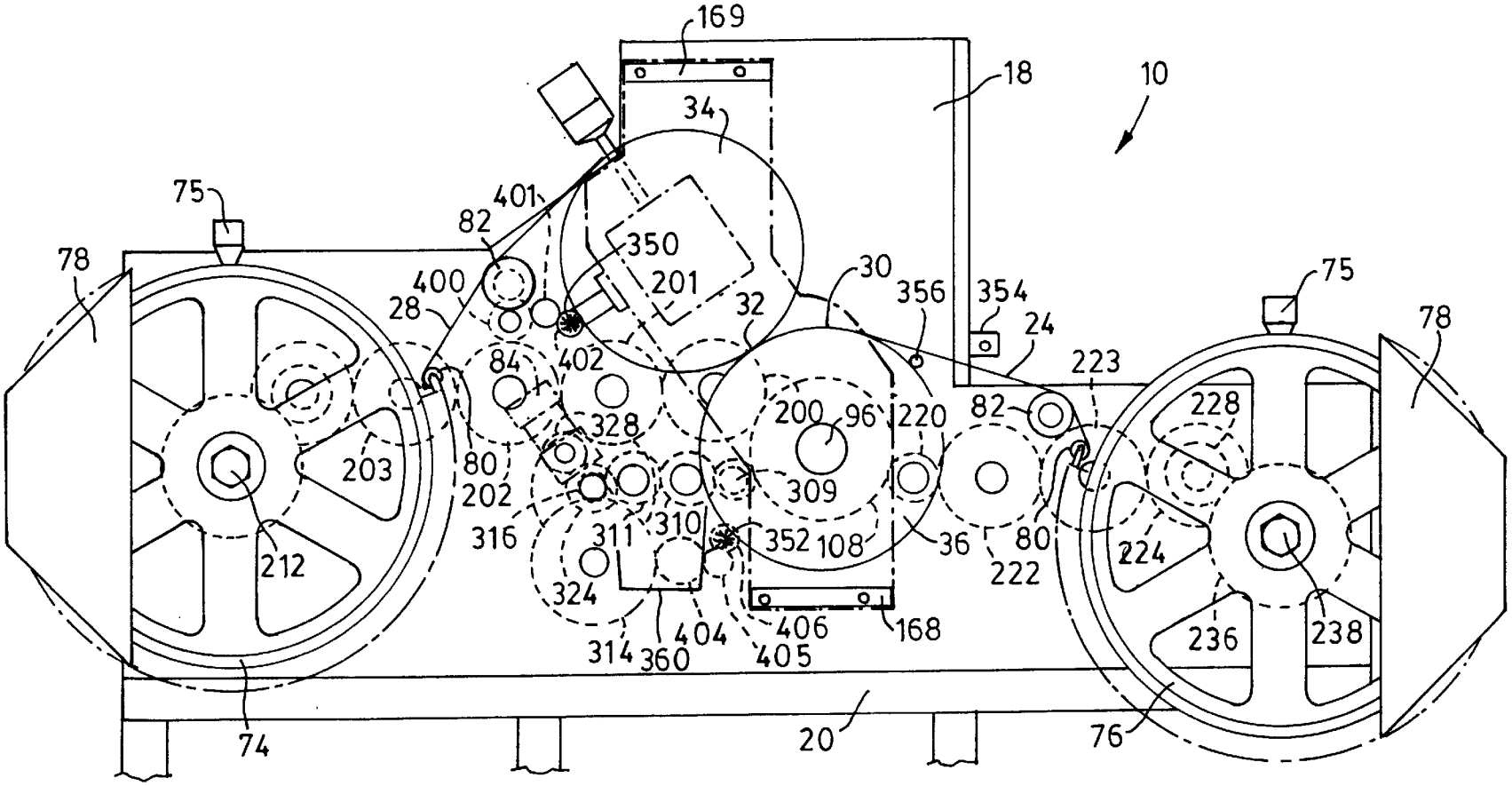
FIG. 1 is a front elevation of an apparatus for enrobing tablets constructed in accordance with the invention, a front cover plate being shown in dot-dashed lines and the tablet feeding mechanism being omitted for sake of illustration.
Figures 2A, 2B:
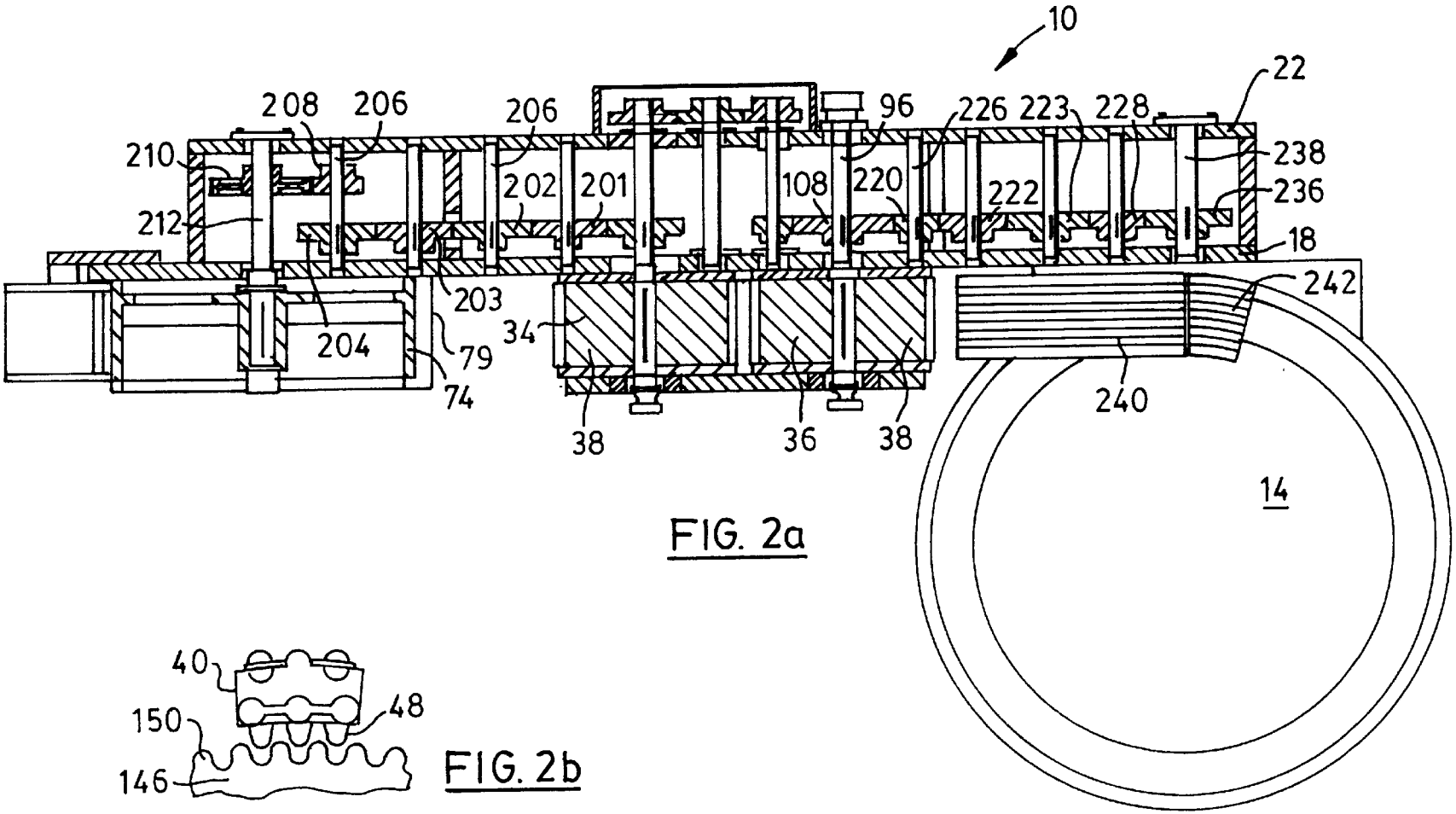
FIG. 2*a* is a top view, partly in cross-section showing front and rear support plates for the apparatus of FIG. 1, a bowl feeder, and chutes that feed tablets to the die assemblies.
FIG. 2*b* is a detail view illustrating the engagement between each die block and its cylindrical support.
Figure 3:
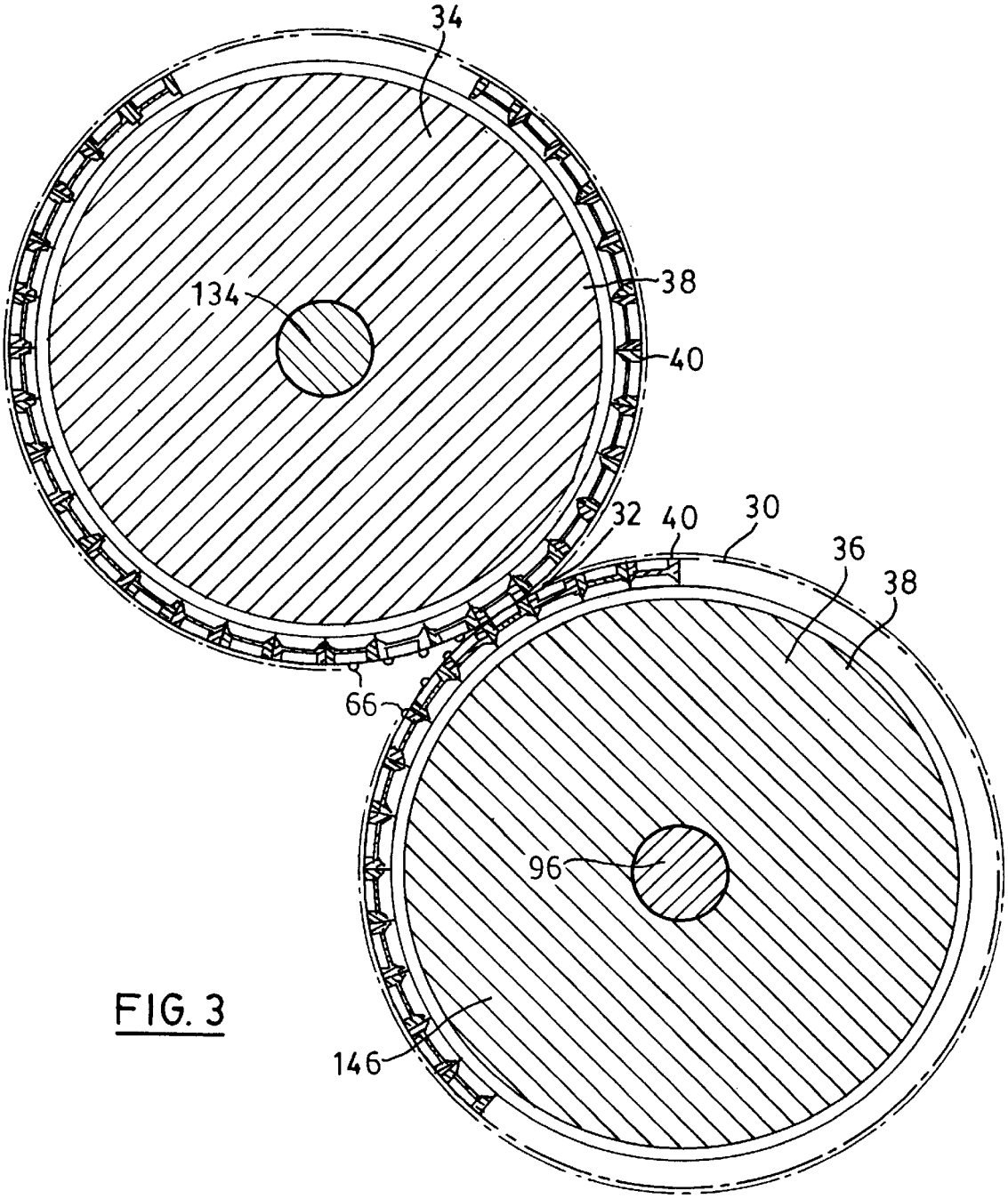
FIG. 3 is an elevational view in vertical cross-section showing the two die assemblies of the apparatus and the nip formed thereby.
Figure 12:
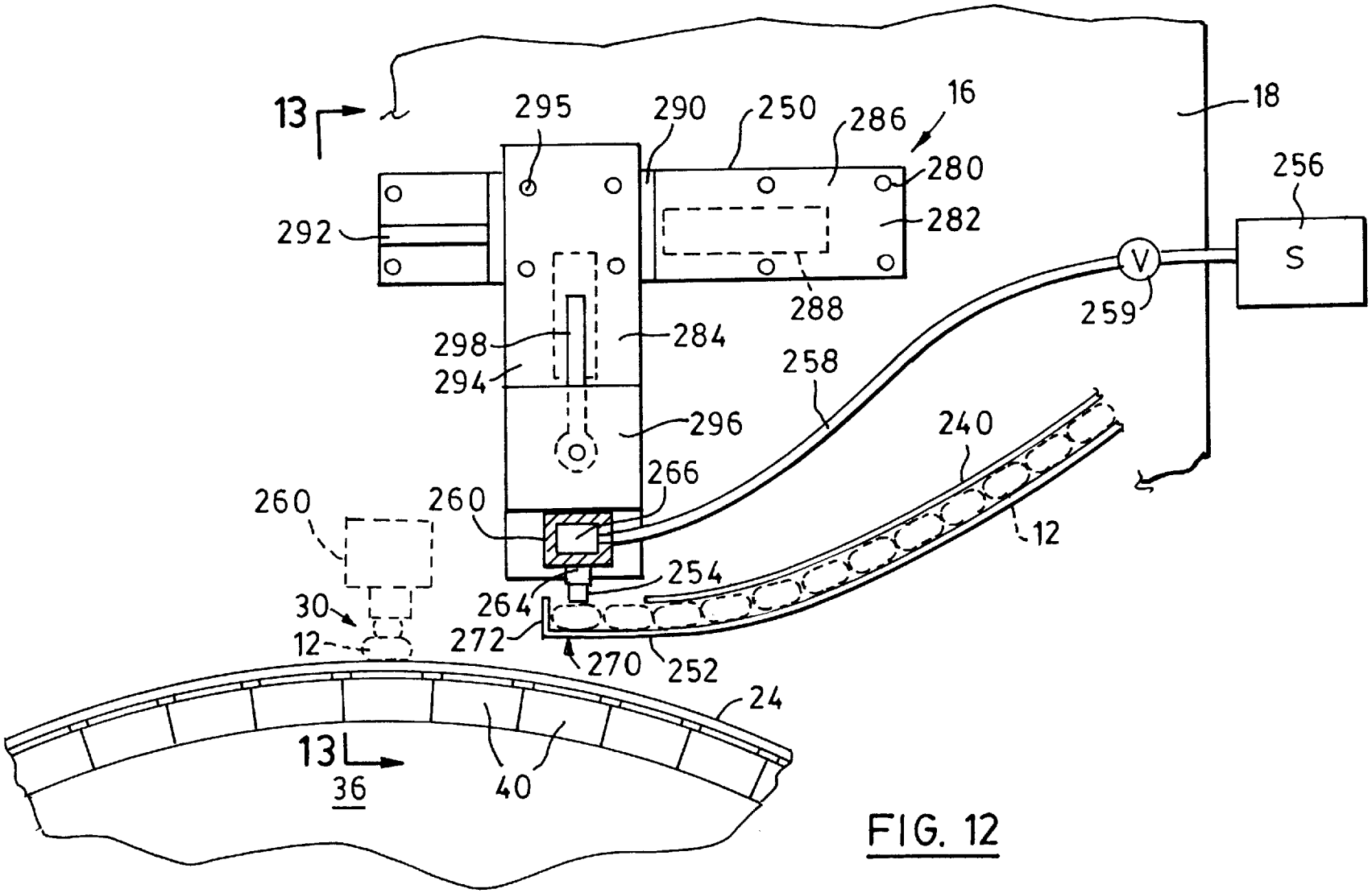
FIG. 12 is a side elevation showing a timed tablet dispensing mechanism for use in the apparatus of FIG. 1.
Figure 13:
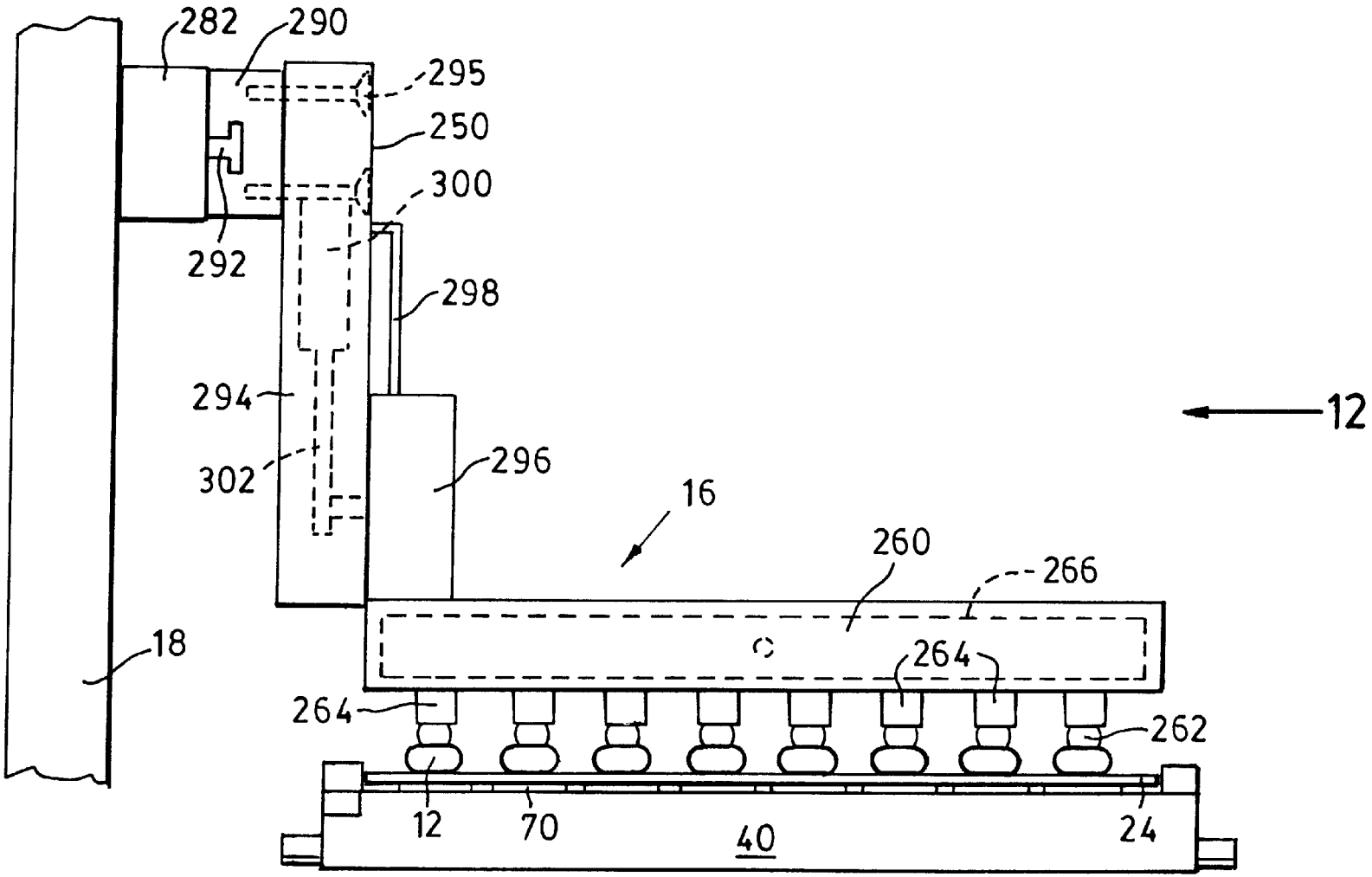
FIG. 13 is a front view of the tablet dispensing mechanism of FIG. 12.

FIGS. 1 to 3 illustrate a preferred apparatus 10 for completely enrobing medicine or similar ingestible tablets in a layer of gelatin, one of these finished tablets being shown at 12 in FIGS. 12 and 13. Not shown in FIG. 1 but shown in FIG. 2 is a bowl feeder 14 which per se is of known construction. Also, not shown in FIGS. 1 to 3 is a timed tablet dispensing mechanism 16, a preferred form of which is shown in FIGS. 12 and 13. This timed tablet dispensing mechanism is mounted rigidly on a front support plate 18 which extends vertically and which is rigidly attached to a rigid base structure 20 of suitable construction. The structure 20 supports the apparatus 10 on a floor or other suitable horizontal surface and only part of the structure is illustrated. Extending parallel to the plate 18 is a rear support plate 22. These plates 18, 22 as well as other metal components and parts of the apparatus are generally made from aluminium or stainless steel due to health and cleanliness requirements for a machine of this type.

Figure 7:
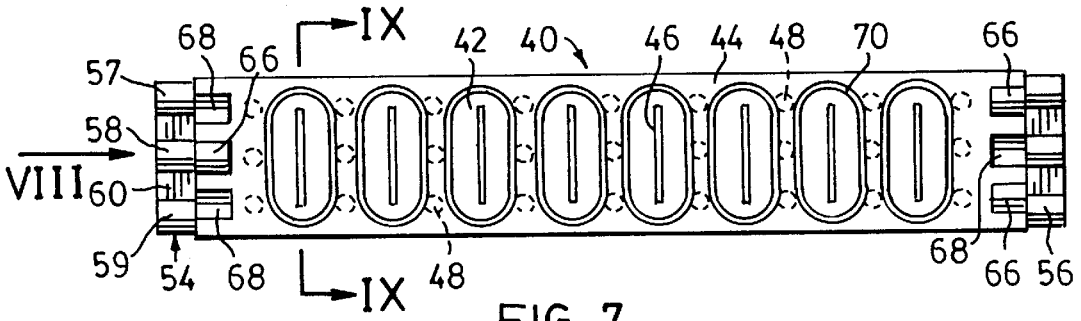
FIG. 7 is a top view of one of the die blocks used on the two die assemblies shown in FIG. 3.
Figure 8:
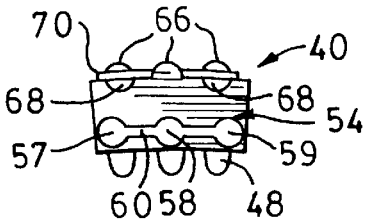
FIG. 8 is an end view of the die block of FIG. 7.
Figure 9:
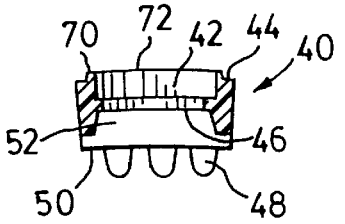
FIG. 9 is a cross-sectional view of the die block taken along the line IX—IX of FIG. 7.

Tablets made with the apparatus 10 are completely enclosed and sealed and comprise preforms supplied from the bowl feeder 14 and a gelatin coating made from two webs or films of gelatin indicated at 24 and 28. Individual preforms are dispensed onto the gelatin strip 24 at a feeding location indicated at 30 which, in a particularly preferred embodiment, is about 6 inches from a nip 32 formed by two cylindrical, rotary die assemblies indicated generally at 34 and 36. The two gelatin strips 24, 28 are brought together at the nip 32. The die assemblies each include a substantially cylindrical, rotatable die support 38 and a series of die blocks 40 mounted on the die support for rotation about a central axis of the die support 38. One of these die blocks 40 is illustrated in FIGS. 7 to 9 and it will be understood that all of the die blocks 40 on the two die assemblies can be of identical construction. For ease of manufacture and reduced costs, the die blocks 40 are preferably made of a durable, tough, hard plastics material and can be made by an injection molding process. A preferred form of plastics material is a carbon fiber reinforced plastics material. In one preferred embodiment of the apparatus 10, the blocks are made of carbon fibre reinforced, heat stabilized polyphthalamide (PPA). This preferred plastics material has a tensile strength of 46,500 psi (ASTM method D638) and a flexural strength of 64,500 psi (ASTM method D790).

Each die block 40 has at least one recess 42 formed in a top surface 44 thereof. It will be understood that each recess of each rotating assembly 34, 36 is cooperable with a similar recess 42 in the other rotating assembly to form a substantially enclosed cavity at the nip 32 formed by the rotating assemblies. This cavity is dimensioned to receive loosely therein one of the tablets 12. The preferred illustrated die block 40 has a number of recesses 42 arranged in a single row that extends longitudinally of the die block and transversely of the block's respective die track 38. Although the illustrated die block is shown with only one row of recesses, it is of course possible to construct a die block with two or more rows of recesses, if desired. The illustrated recesses are substantially oval in shape in order to accommodate tablets of this general shape, but it will be understood that other shapes, for example, round, are also possible depending upon the shape of the tablets for which the apparatus is designed. Slots or holes 46 can be provided in the bottom of the recesses in order to permit the escape of air from the recesses during the tablet encapsulating process. Each die block 40 is formed with two or more rows of teeth 48 on a bottom 50 thereof. In one embodiment of the block having eight recesses on top, there are nine rows of three teeth per row, each extending transversely of the elongate block. By employing this number of rows of teeth, one ensures that no undue load or stress will be placed on individual teeth as the blocks rotate with the die support.

Figure 10:
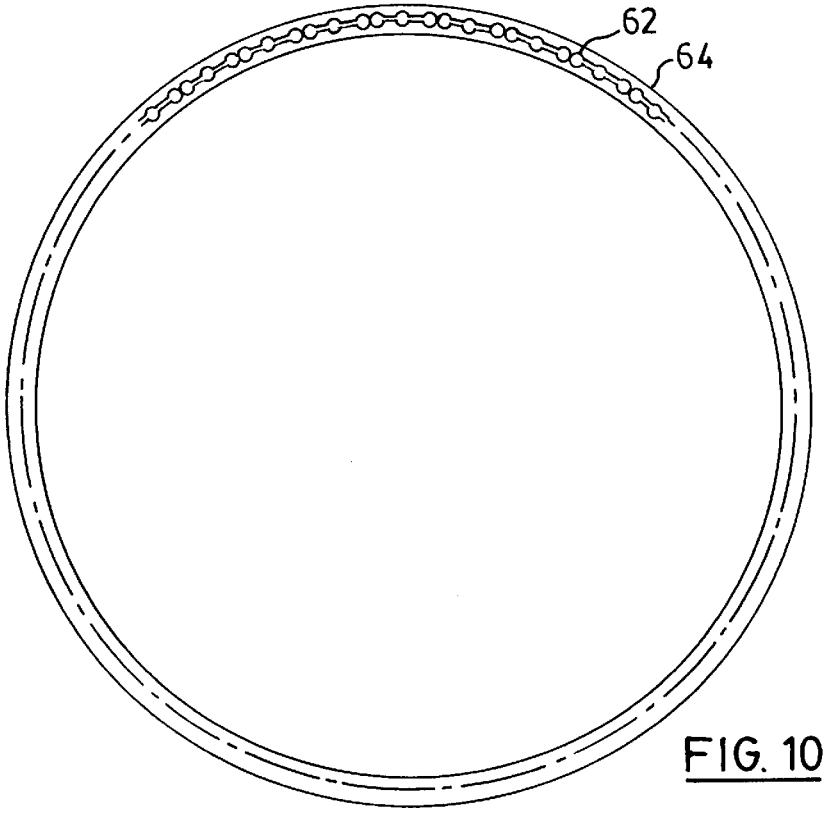
FIG. 10 is a side view of a metal bearing ring used to space the die blocks in the assembly, the ring being shown on the side facing the die blocks.

The preferred die blocks are formed with bottom cavities 52, the number and shape of which can correspond to the number and shape of the recesses 42. Two rows of the teeth 48 are located on each side of each cavity 52. Each die block is molded with laterally projecting connecting members 54, 56. In the illustrated embodiment, each of these connecting members comprises three, generally cylindrical protuberances 57, 58 and 59 and these are connected by integral webs 60. These connecting members 54, 56 extend respectively into a hole or holes 62 having a similar cross-sectional shape in a metal bearing ring 64, one of which is shown in FIG. 10. There are two of these rings 64 mounted in each die rotating assembly, one on each side of the series of die blocks. These rings, which can be made of bronze, act to connect together each series of die blocks so that they are uniformly spaced relative to one another about their respective die support. The rings are detachably connected to the die blocks as the connecting members 54, 56 are simply slid into their holes 62.

The preferred die block 40 also includes die locating members 66 that project upwardly from opposite ends of the top of the die block and help to align the die block with another cooperating die block of the apparatus during use thereof. In the block 40 as illustrated in FIG. 7, there is one central die locating member 66 at the left end and two members 66 at the right end. There are also die locating recesses 68 formed at opposite ends of the top of the die block 40. It is the combination of the members 66 and the recesses 68 which help to align the die block 40 with another cooperating die block. It will be understood that the recesses 68 are sized to receive the members 66 of the cooperating die block which will be arranged so that its end sections are the reverse of the end sections of the first die block.

A raised rim 70 extends about the perimeter of each recess 42 for cutting the gelatin web or strip 24, 28 after it is laid over the top of the block and is pulled into the nip 32. The top edge 72 of the rim should be slightly curved from one end of the recess to the opposite end to match the curvature of the circumference of the die support. In this way, opposing rims on opposing die blocks as they pass through the nip 32 will evenly and fully cut through the gelatin webs in order to encapsulate the tablet. Preferably, the rims 70 formed on the top of the die blocks 40 have a width from one to two times the thickness of the gelatin web which is laid over the recess. For example, for a small sized tablet or capsule, the width of the rim can be approximately 0.04 inch. The height of the rim 70 should be more than the thickness of the gelatin web.

Returning to FIG. 1, there is shown therein feed means for delivering a gelatin strip 24, 28 of selected thickness and composition to each of the die rotating assemblies 34, 36. The films or webs 24, 28 are cast on separate, rotating casting drums which per se are of known construction. These drums 74,76 can be made of stainless steel. It will be understood that the gelatin in a liquid state is delivered to each drum through a heated hose (not shown). Before use, the gel is stored in a jacketed tank that maintains the liquid gel at a temperature of at least 140 degrees F. By force of gravity, the liquid gel passes through the hoses to a spreader box 75 located at the top of each casting drum. The spreader box itself can be heated with two heating cartridges to maintain the liquid gelatin at a temperature of about 140 degrees F. The liquid gel is spread onto the casting drum which rotates and forms the gel into a ribbon or strip. A fan blower 78 is provided on each casting drum and acts to cool the gelatin so that it is changed into a solid strip that can be peeled from the casting drum at a small, adjustable roller 80. Preferably a metal cover 79 extends over the strip formed on the drum. The thickness of the gel strip can range from ten to thirty thousands of an inch. Each gel strip passes over a rotating oil roller 82 which applies a thin layer of oil on the outside surface of the strip. The oil helps to ensure the release of the gelatin strip from its respective die rotating assembly after the strip passes through the nip 32. The gelatin web 24 then extends to the lower die assembly 36 where it is laid on the die blocks 40 located at the top of the assembly. The gelatin web 28 extends to the upper die assembly 34 where it is placed over rotating die blocks extending across the top of the die assembly 34 and down one side thereof to the nip 32. After the two webs 24, 28 pass through the nip 32, they are adhered to each other and, in this state, they are pulled down through a scrap ribbon puller 84 which is shown in detail in FIGS. 6*a* and 6*b*. The used gelatin web can then be deposited in a suitable container (not shown) for subsequent disposal.

Figure 4:
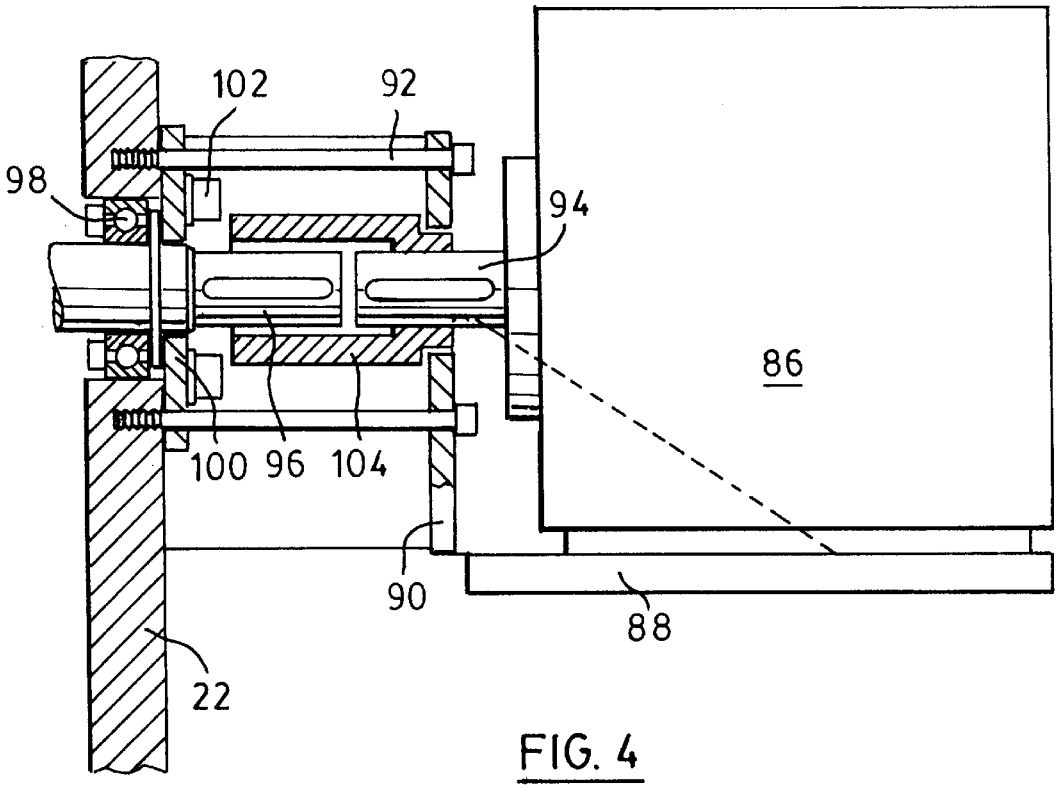
FIG. 4 is an elevational view, partly in cross-section, showing a drive motor and drive shaft for the apparatus.

A drive system is provided for rotating both die assemblies 34, 36 about their respective central axes so that the two series of blocks move in synchronism with each other. The start of the preferred drive system is shown in FIG. 4 and it begins with an electric motor 86. The illustrated motor is mounted on a horizontal support plate 88 but it is also possible to mount the drive motor on the floor. A vertically extending bracket 90 is used to secure the plate 88 to the main rear plate 22 which can be one inch aluminum or stainless steel plate. Four connecting bolts 92 extend between the bracket 90 and the rear plate 22. An output shaft 94 of the motor is connected to a main drive shaft 96 which is rotatably mounted in the rear plate 22 by means of ball bearings 98. These bearings are held in place by a bearing cover plate 100 and bolts 102. A standard shaft coupling 104 secures the motor shaft 94 to the shaft 96. It will be understood that if the motor 86 is mounted on the floor, suitable pulleys and a drive belt 97 can connect the motor output shaft 94 to the shaft 96. A drive of this type is shown in part in FIG. 5.

Figure 5:
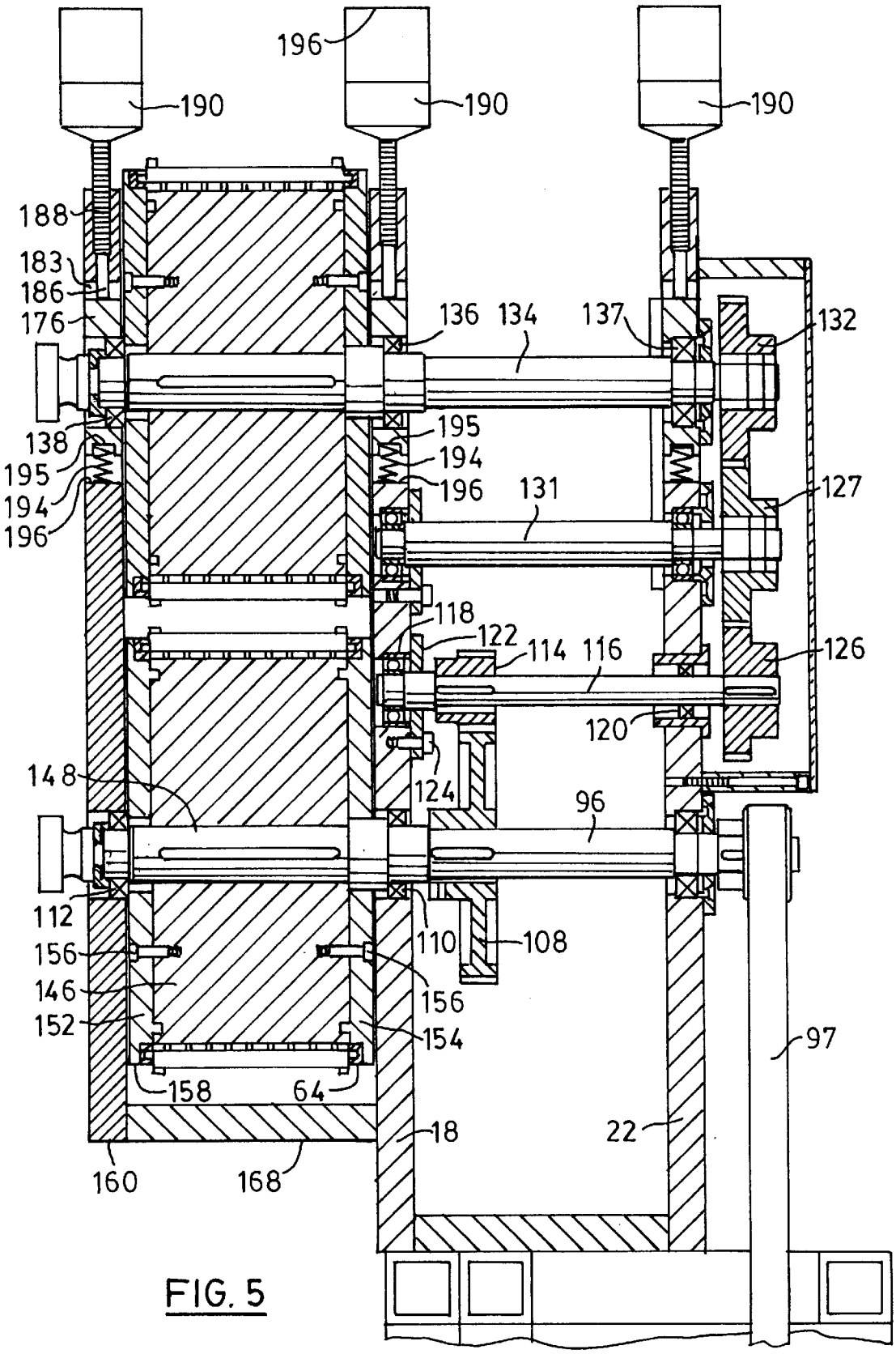
FIG. 5 is a cross-section taken along the line 5—5 of FIG. 1 showing details of the die assemblies.

With reference now to FIG. 5, the forward section of the main drive shaft 96 is shown extending through main drive gear 108. The forward section of the shaft is rotatably mounted in the front plate 18 which can also be one inch plate and in front bracket plate 160. Ball bearings 110, 112 rotatably support the shaft. The drive gear 108 rotates a smaller drive pinion or gear 114 mounted on horizontal shaft 116. The shaft 116 is supported in ball bearings at 118 and 120. The bearings 118 are secured in the front plate 18 by means of bearing cover plate 122 and connecting bolts 124. The shaft 116 which is made of stainless steel supports a drive gear 126 mounted to the rear of rear plate 22. Gear 126 engages a similar gear 127 mounted on rotatable shaft 131. The gear 127 operatively engages another similar gear 132 of equal size mounted on stainless steel drive shaft 134. The shaft 134 extends through the front and rear plates and a passageway formed along the central axis of the upper die assembly 34. The shaft 134 is rotatably supported by three ball bearings at 136, 137, 138. The two series of die blocks 40 and their cylindrical supports are rotated at the same speed. The central shaft 134 is used to properly position the die assembly 34 relative to the lower assembly 36.

The preferred construction of each die rotating assembly 34, 36, will now be explained with reference to FIG. 3 and particularly FIG. 5. Reference will be made to die rotating assembly 36 shown in detail in FIG. 5 and it will understood that the assembly 34 is constructed in a similar manner. The main component of the die track is a solid, cylindrical aluminum block 146 through the center of which is a passageway 148 which accommodates the forward end section of the main drive shaft. A series of small, transversely extending teeth 150 are formed about the circumference of this block for engagement with the rows of teeth formed on the bottom of the blocks 40 (see FIG. 2*b*). In one preferred embodiment, the diameter of this block is eleven inches. The teeth 150 extend the width of the block 146 preferably. Connected to opposite sides of the block are two circular stainless steel side plates 152, 154 which can have a thickness of ¾ inch. These plates are rigidly connected to the block by means of connecting screws 156. An annular flange is formed about each plate 152, 154 at 158 in order to hold each bronze ring 64 in place.

The bottom end of the bracket plate 160 can be detachably connected to the front plate 18 by means of connecting plate 168 and suitable screws can be used for this purpose. A similar connecting plate 169 can connect the top of bracket plate 160 to the front plate.

Figure 11:
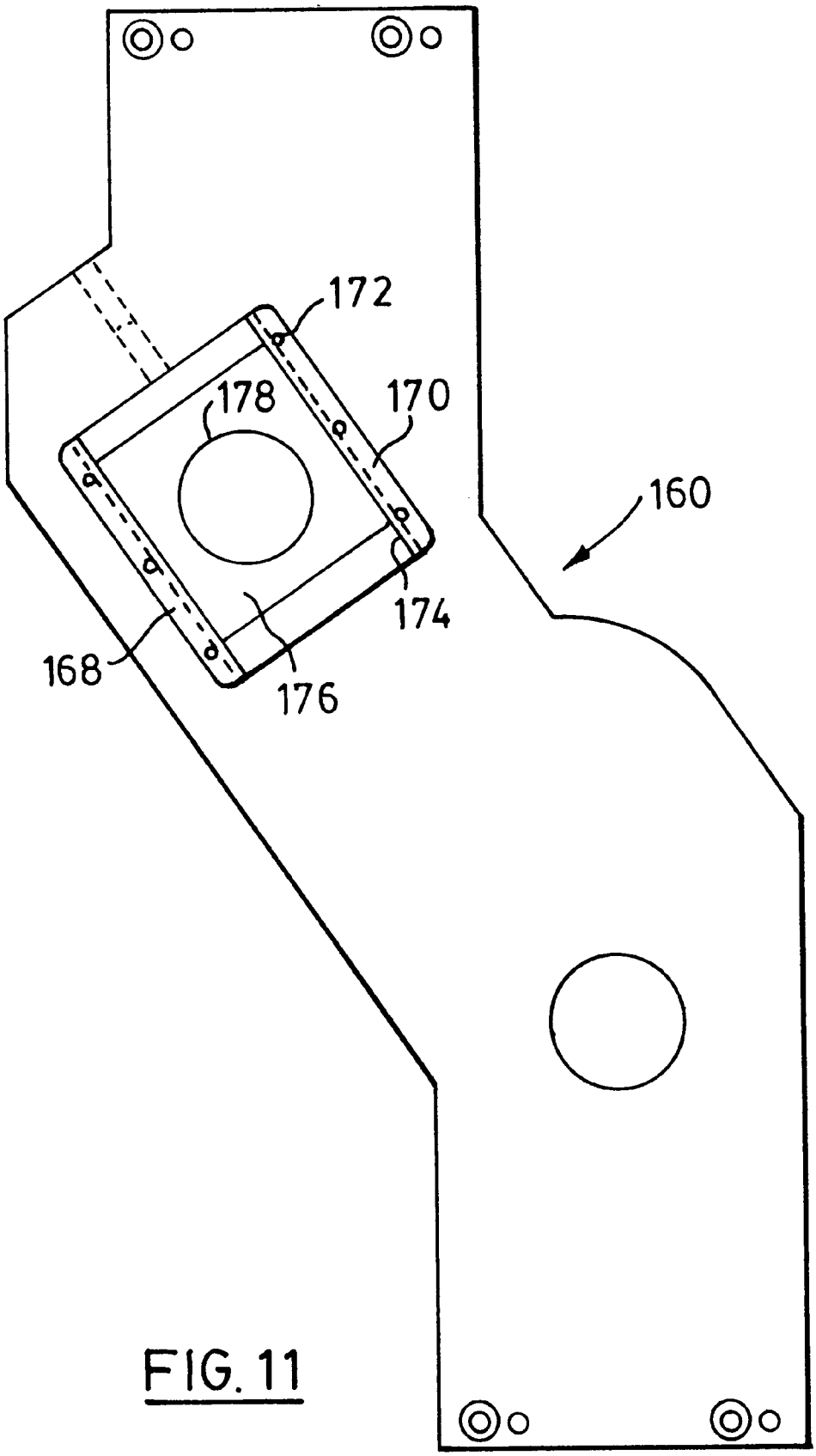
FIG. 11 is a front elevation illustrating the front bracket plate that covers the front of the rotary die assemblies.

The upper die rotating assembly 34 is adjustably mounted to the front plate 18 and the front bracket plate 160. The adjustable mounting for the shaft 142 is substantially the same on each of the plates 18, 22 and 160 and therefore reference will be made only herein to the adjustable support on the front bracket plate 160. As shown in FIG. 11, two straight, parallel guide plates 168, 170 are attached by screws 172 to the outer surface of the plate 160. The guide plates have an inner edge 174 that projects over a rectangular opening 183. These plates 168, 170 hold in a sliding fashion a rectangular support plate 176 having a central hole 178. This plate 176 is movable up or down in the opening 183 formed in the plate 160. The bearing 138 is mounted in the plate 176. Bearing on the top edge of each plate 176 is a pressure pin 186 that extends downwardly from the end of a threaded pin or screw member 188 that is part of a die plate pressure gauge 190. The preferred gauges 190 have a gauge dial (not shown) in their top end 192 which provides a pressure readout, this pressure being readable in psi. In a preferred embodiment, turning each pressure gauge in the clockwise direction puts further pressure on the top of the plate or slide 176. This plate and the attached die assembly move against the pressure of two or more coil springs 194, the upper ends of which can be accommodated in cylindrical cavities 195 formed in the bottom of the plate 182. The bottom end of each spring presses against support surface 196 in the bracket plate 160. As shown in FIG. 5, preferably three pressure gauges of similar construction are used in order to provide for fine adjustment of the position of the upper die assembly 34 and its shaft 134.

The preferred gear arrangement for rotating the two casting drums 74, 76 at the same rate and at the same time by means for the single main drive shaft 96 will now be described with particular reference to FIGS. 1 and 2. The shaft 96 rotates the main drive gear 108 shown in FIG. 5 and outlined in dotted lines in FIG. 1. This drive gear turns five identical idler gears 200 to 204 arranged in a horizontal row each of which is mounted on its own rotatable shaft 206. These shafts are mounted by means of ball bearings in rear support plate 22 and in the front plate 18 as shown in FIG. 2. Mounted on the last shaft 206 is a smaller gear 208 which rotates with the idler gear 204 and drives a larger gear 210. This gear is mounted on rotatable shaft 212 that rotatably supports the casting drum 74. It will be understood that the gear sizes are arranged to drive the casting drum at the required rotational speed upon rotation of the main drive shaft 96.

In order to drive the casting drum 76, the main drive gear 108 rotates a small idler gear 220 which then rotates three identical and in line idler gears 222 to 224. The gear 224 has been omitted from FIG. 2 for sake of illustration. Idler gears 222, 223 and 224 are supported on their respective shafts 226 which are rotatably supported in front plate 18 and rear plate 22. Mounted on outermost shaft 226 is a second, smaller gear 228 shown in outline in FIG. 1. The gear 228 in turn drives a larger gear 236 which is mounted on a relatively large shaft 238 on which the casting drum 76 is mounted. Thus rotation of the main drive shaft 96 also rotates the casting drum 76 and at the same speed as the drum 74.

Turning now to the means for dispensing tablets onto the gelatin strip 24, the aforementioned bowl feeder 14 is able to deliver properly oriented pills to a number of tablet chutes 240 which extend downwardly along a slope from the outlet of the bowl feeder located at 242. If there are eight recesses 42 formed in each die block, then there are eight separate chutes 240 which form eight sloping lines of tablets. The chutes are each sized to receive the preforms or tablets arranged in a single line and properly oriented and they are arranged side-by-side across the width of the die rotating assembly 36. Preferably the chutes are made of a slippery, non-abrasive material so that the preforms slide easily therealong. The inclination of the chutes should be sufficiently great that the preforms will slide easily under the force of gravity but not so great as to put any undue weight on the preforms at the bottom of the chutes. The chutes extend downwardly to a location near the feeding location 30 at the top of die rotating assembly 36. The tablet dispensing mechanism includes a tablet transfer device indicated generally at 250 in FIGS. 12 and 13. The illustrated device is able to move eight tablets 12 from a bottom section 252 of the chutes to the gelatin strip 24 which, at this time is supported by the die blocks 40. The preferred transfer device includes vacuum applying members 254 used to pick up tablets 12 from their respective chutes and a vacuum source 256 indicated only schematically in FIG. 12. The vacuum source is operatively connected to the vacuum applying members by means of a vacuum line or hose 258 in which is mounted a suitable vacuum control valve 259. The end of the line 258 can be connected to a horizontally extending tubular support member 260 which can extend substantially the length of the adjacent die blocks, as shown in FIG. 13. The illustrated preferred vacuum applying members include a rubber or rubber-like suction cup 262 sized to fit on top of the tablet 12 and a tubular metal cup connector 264 which is firmly connected to the bottom of the support member 260. A plenum chamber 266 inside support member 260 is enclosed and is evacuated by means of the vacuum line 258. Each vacuum applying member 254 is operatively connected to this plenum and accordingly vacuum is provided to each of the members 254 when required to pick-up a tablet. It will be appreciated that the valve 259 is provided to control the vacuum in the plenum and in the members 254 and air can quickly be supplied to the plenum and to the members 254, when required, to release the tablets onto the gelatin strip.

The tablets 12 are each picked up by a respective vacuum applying member 254 at a tablet pick-up position indicated at 270 in FIG. 12. This position is at the end of the tablet chute 240. The ends of the chutes are closed by vertically extending end wall 272 but the top of the end section of each chute is open to permit the lifting of individual tablets at the bottom end of the chutes. It will be understood that the tablet transfer device causes the vacuum applying member 254 to go through the following operational sequence. The members 254 with their flexible vacuum cups are positioned directly above the bottom tablets and they are then lowered into contact with the end tablets. Preferably the vacuum cup 262 is applied to the front portion of the top of the tablet 12. This is done to ensure that in the eventuality that the bottom tablet is cracked or split, the vacuum cup will always pick up at least the portion of the tablet at the very end of the chute, in other words, the portion adjacent to the end wall 272. Thus, any unwanted build up of pieces of tablets at the bottom end of the chutes is largely prevented.

After the vacuum cup has been lowered to the top of the pill, vacuum is generated in the plenum chamber 266, thus permitting the vacuum cup to grip the end tablet securely. The members 254 are then lifted together with the support member 260, the end tablets being raised sufficiently to clear the end wall 272. Then, the transfer device 250 causes the tablets with the support member 260 to be moved about one to one half inches horizontally and then the tablets and the member 260 are lowered so that the bottom of each tablet is just above the surface of the gelatin web. At the same time as the tablet reaches this position above the gelatin web, the vacuum in the plenum 260 is eliminated, thereby releasing the tablets 12. It will be understood that the operation of the tablet dispensing mechanism is synchronized with rotation of the die blocks, particularly the blocks on the assembly 36 so that each tablet 12 is released over a respective one of the recesses of the blocks.

The preferred transfer device 250 shown in FIGS. 12 and 13 is firmly mounted by means of screws 280 to the front plate 18. The preferred transfer device 250 comprises first and second air cylinder drive devices with the first drive device 282 providing substantially horizonal movement and the second drive device 284 providing substantially vertical movement. Each of these drive devices can be of standard construction for such devices and therefore a detailed description herein is deemed unnecessary. Briefly, the horizontally extending first drive device 282 includes a rigid slide table 286 containing an air cylinder or air chamber indicated in dashed lines at 288. Slidingly mounted on this table is a rectangular support block 290. A guide rail 292 extends longitudinally along the center of the slide table 286 and extends along a slot or groove having a similar cross-sectional shape in the block 290. Movement of a piston member (not shown) in the air cylinder 288 causes the block 290 to move horizontally back or forth as required. The movable piston is connected to the block 290. The second vertical drive device 284 is constructed in a similar fashion and includes a vertically extending slide table 294 which is rigidly mounted to the block 290 by means of connecting bolts or screws 295. A rectangular support block 296 is slidably supported on the slide table and moves along a central, longitudinal rail 298. Again, an air cylinder 300 is provided in the table 294 and a piston member 302 slidable in this cylinder is connected to the support block 296. It will be understood that both of the drive devices 282 and 284 are connected to pressurized air hoses (not shown) which provide pressurized air to these drive devices in order to operate same. The support block 296 is firmly and rigidly connected to tubular support member 260 and is thus able to move the member 260 upwardly or downwardly when required.

Figure 6A:
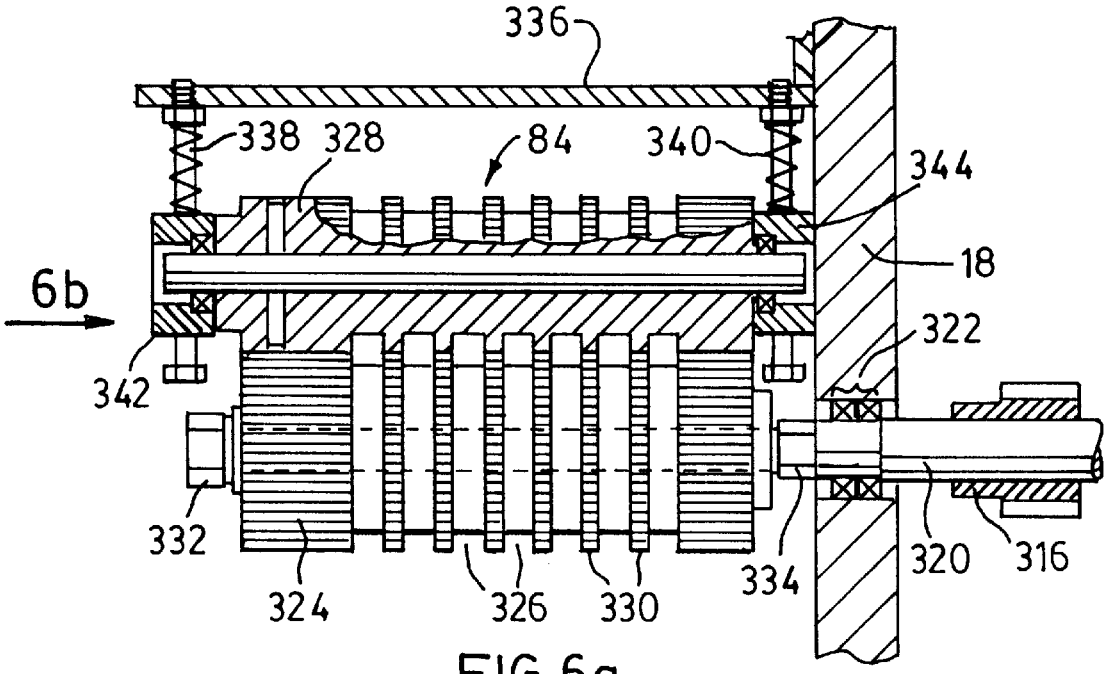
FIG. 6*a* is a cross-sectional elevation taken along the line 6*a*—6*a* of FIG. 6*b* showing a scrap ribbon roller and cooperating spring loaded roller mounted downstream of the rotary die assemblies.
Figure 6B:
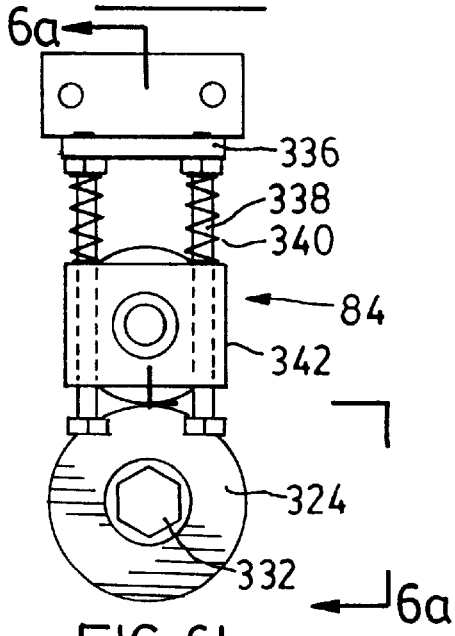
FIG. 6*b* is a left end view of the rollers of FIG. 6*a* and the mounting therefor.

Turning now to the construction of the scrap ribbon puller 84 illustrated in FIGS. 6*a* and 6*b*, this device is driven by a gear train illustrated in FIG. 1 from the main drive shaft 96. In particular, the main drive gear 108 drives a small idler gear 309 which in turn drives two similar, larger idler gears 310, 311. The idler gear 311 drives small gear 316 which in turn drives a larger idler gear 314, the purpose of which is described later herein. The gear 316 drives a scrap ribbon roller 324 shown in FIG. 6*a*. It will be appreciated that this gear train is rotatably supported by shafts extending through and mounted in the front plate 18.

Shown in FIG. 6*a* is front plate 18 through which extends drive shaft 320 on which the gear 316 is mounted. A pair of ballbearings at 322 support the shaft in the plate 18. The scrap ribbon roller 324 is mounted on the shaft 320 for rotation therewith and this roller has a number of circumferential grooves 326 spaced evenly apart. These grooves are provided to permit any tablets that remain on the scrap ribbon to pass through the nip formed by the roller and adjacent spring loaded roller 328 (shown in cross-section). Small gripping teeth can be formed on the ridges 330 in order to enable the roller to hold onto and pull the scrap ribbon better. A nut 332 and suitable washers hold the roller in place on the shaft 320. An annular spacer 334 helps keep the roller in position.

The upper spring loaded roller has grooves which are aligned with the grooves 326 and the ridges which form the grooves also have gripping teeth. The roller 328 is supported by means of a horizontal support bracket 336 connected to front plate 18 and four downwardly extending posts 338 about which extend coil springs 340 used to spring load the roller. The posts are threaded into the bracket 336 from below. On the posts are mounted two bearing holders 342, 344. Roller bearings are mounted in the holders to rotatably support the roller 328. It will be appreciated that the upper roller 328 acts to press downward on the scrap ribbon so that the scrap ribbon is firmly gripped between this roller and the roller 324. Both these rollers can be made from aluminum.

The encapsulated tablets normally fall from the die blocks 40 after they pass through the nip. Those tablets which remain in the recesses in the die blocks are removed from the recesses by means of knock-out brushes 350 and 352 which sweep across their respective series of die blocks. The position of these brushes is indicated in FIG. 1.

Separate gear trains can be provided to rotate each of the brushes 350 and 352, the gear train for the upper brush 350 being driven by the idler gear 202 and the gear train for the lower brush 352 being driven by the gear 316. The gear 202 drives a series of three small gears 400, 401 and 402 with the last gear 402 being mounted on the same shaft as the brush 350. The first gear 400 can also be used to rotate the oil roller 82, if desired. The gear 316 drives a series of four gears 314 and 404 to 406 with the gear 314 being substantially larger than the other gears. The small gear 406 is mounted on the same shaft as the brush 352. It will be understood that the rotatable shafts for both of these gear trains are mounted in the front plate 18.

In order to ensure that the two gel strips 24 and 28 are heated to an adequate temperature for the encapsulation step, a heat light 354 can be located above the gel strip 24 at the location indicated in FIG. 1. In one preferred embodiment, this location is about twelve inches away from the nip where the two gel ribbons meet. The heat light can be rigidly mounted on the front plate 18. It will be appreciated that the heat light heats the gelatin strip 24 sufficiently so that it becomes sticky and pliable so that when the tablets are dropped onto the strip, they will stick to it and remain in place as they pass through the nip. A separate heat light can be provided to heat the strip 28 if the single light 354 is not sufficient for this purpose.

Mounted adjacent the perimeter of the lower die rotating assembly 36 is an electronic sensor 356 which per se can be of standard construction. This sensor accurately senses the rotational position of the die blocks 40 on the assembly 36. This sensor is connected to a programmable logic controller (not shown) which also can be a standard type of controller suitable for controlling the operation of the above described tablet transfer device 250 and vacuum applying members 254. This logic controller controls the operation of the first and second air cylinder drive devices 282 and 284 and the application of vacuum to the members 254 so that these devices will know when to pick up tablets from the bottom end of the chute, transfer them to the moving gelatin strip 24 and release them.

After the encapsulated tablets are formed by the rotating die assemblies, the tablets will normally fall under the force of gravity into a container 360 provided below the downwardly moving section of the scrap ribbon as shown in FIG. 1. Tablets which remain stuck on the scrap ribbon will be able to pass through the scrap ribbon roller 84 because of the grooves formed therein.

In addition to the heat light(s) 354 for heating the gelatin strips, there can be provided other conditioning means for the gelatin strips so that they have a predetermined deformability and adhesivity to the tablets and to each other. For example, the entire apparatus 10 is best located in an air conditioned room so that temperature and humidity may be controlled to maintain the desired condition of the films.

It will be appreciated by those skilled in the art that various modifications and changes can be made to the described apparatus for enrobing tablets and to the described die blocks without departing from the spirit and scope of this invention. For example, instead of employing the tablet dispensing mechanism illustrated in FIGS. 12 and 13, one could employ known tablet dispensing mechanisms such as that illustrated in FIG. 26 of U.S. Pat. No. 5,459,983, the specification and drawings of which are incorporated herein by reference. In this known dispenser, the preforms pass through chutes and an eccentric cam mounted on a drive shaft extends into each tubular chute through a side opening and contacts a tablet in the chute. The cam contour is defined in combination with the rate of rotation of its shaft to engage a tablet in the chute each time a row of recesses in the die blocks 40 reaches a desired position and to drive the tablets in each chute a desired distance along the chutes, this distance being sufficient to permit the end tablet in each chute to drop out of the chute and onto the passing web. A resilient element, ie. a leaf spring, is mounted at the bottom end of each chute to hold the lowermost tablet in the chute until the aforementioned cam operation forces it past the resilient element.

As indicated, many variations of this invention will suggest themselves to those skilled in this art. Accordingly, all such modifications and changes as fall within the scope of the appended claims are intended to be part of this invention.

I claim:

1. An apparatus tor enrobing tablets in a gelatin layer, said apparatus comprising:

a pair of cylindrical, rotary die assemblies, each die assembly including a substantially cylindrical, rotatable die support and a series of separable die blocks mounted on said die support for rotation about a central axis of the die support, each block having at least one recess formed in a top surface thereof and each recess of one die assembly being cooperable with a similar recess in the other die assembly to form a cavity at a nip formed by said die assemblies, each cavity being dimensioned to receive loosely therein one of the tablets;

a drive system for rotating both die assemblies around their respective central axes so that the two series move in synchronism with each other;

feed means for delivering a gelatin strip of selected thickness and composition respectively to each of said die assemblies, whereby during use of the apparatus, each gelatin strip is pulled by a respective one of said die assemblies into said nip and is laid on a section of the series of die blocks of the respective die assembly; and a timed tablet dispensing mechanism for dispensing individual whole tablets onto one of said gelatin strips at a feeding location that is upstream of said nip and horizontally spaced away from said nip, wherein each dispensed tablet moves with said one gelatin strip into said nip and portions of both gelatin strips are stretched about the dispensed tablet in a respective one of the cavities so that the tablet is enrobed by said portions of both strips.

2. An apparatus according to claim 1 wherein each die block of each series has a number of recesses arranged in one or more rows extending transversely of its respective die assembly and is made of a hard plastics material.

3. An apparatus according to claim 1 wherein each die block of each series is formed with two or more rows of teeth on a bottom thereof and each die support includes a series of teeth extending about the circumference of the die support and adapted to engage said rows of teeth on the blocks in order to move the series of blocks with its respective die support.

4. An apparatus according to claim 2 wherein said tablet dispensing mechanism includes a bowl feeder and a number of vertically extending tablet chutes which in operation are fed properly oriented whole tablets by said bowl feeder.

5. An apparatus according to claim 2 including means for connecting together each series of die blocks, said connecting means comprising two metal rings detachably engaged with two opposite sides of the series of die blocks and mounted on the respective die support for rotation therewith.

6. An apparatus according to claim 5 wherein each die block is molded with laterally projecting connecting members on opposite ends thereof and each connecting member extends into a hole formed in an adjacent one of the rings.

7. An apparatus according to claim 2 wherein each die block is made of carbon fibre reinforced plastics material.

8. An apparatus according to claim 5 wherein said drive system includes a rotatable main drive shaft connected to a first of said die assemblies to rotate same, a first gear fixedly mounted on said main drive shaft, a driven shaft on which a second of said die assemblies is mounted, and a gear train operatively connecting said first gear to said driven shaft in order to rotate the latter upon rotation of the main drive shaft.

9. An apparatus according to claim 8 wherein each die block is made of carbon fibre reinforced, heat stabilized polyphthalamide.

10. An apparatus for enrobing tablets in a gelatin layer, said apparatus comprising:

a pair of cylindrical, rotary die assemblies having coacting working surfaces which meet at an assembly nip, each die assembly having a number of recesses formed in its working surface along a circumferential line, each recess being cooperable with a similar recess in the other die assembly to form at the assembly nip a cavity dimensioned to receive loosely therein one of said tablets;

a drive system for rotating said die assemblies so that the die assemblies rotate in synchronism with each other;

feed means for delivering two gelatin strips to said die assemblies whereby during use of said apparatus, the gelatin strips are pulled by said die assemblies into said nip; and a timed tablet dispensing mechanism for dispensing individual tablets onto one of said gelatin strips at a feeding location upstream from said assembly nip and horizontally spaced away from said nip, said one gelatin strip being supported by the working surface of one of the die assemblies at said feeding location, said tablet dispensing mechanism including at least one vacuum applying member operatively connectible to a vacuum source and mounted to a horizontally extending, dually movable frame of said a transfer mechanism for moving via air cylinder drive devices said at least one vacuum applying member from a tablet pick-up position, where vacuum suction is used to pick-up and hold at least one tablet, to said feeding location where said at least one tablet is released by said at least one vacuum applying member onto said one gelatin strip, said at least one tablet being released by termination of the vacuum suction, wherein the operation of said tablet dispensing mechanism is synchronized with rotation of said die assemblies so that each tablet is released over a respective one of said recesses of said one die assembly.

11. An apparatus according to claim 10 wherein each die assembly includes a substantially cylindrical, rotatable die support and a series of seperable die blocks mounted on said die support for rotation about a central axis of the die support.

12. An apparatus according to claim 10 wherein each die assembly has a central axis of rotation, one of said die assemblies is located at a lower level than the other die assembly so that one of the two central axes of the die rotating assemblies is below the other of the two central axes, and said feeding location is on top of said one die assembly which is on a lower level.

13. An apparatus according to claim 11 wherein each die block has a number of said recesses arranged in at least one row extending transversely of its respective die support.

* * * * *

UNITED STATES PATENT AND TRADEMARK OFFICE

CERTIFICATE OF CORRECTION

PATENT NO. : 6,018,935
DATED : February 1, 2000
INVENTOR(S) : Aldo Perrone

It is certified that error appears in the above-identified patent and that said Letters Patent is hereby corrected as shown below:

Column 6,
Line 60, after "will" insert -- be --.

Column 11,
Line 40, "ie." should be -- i.e. --.
Line 49, "tor" should be -- for --.

Column 12,
Line 8, after line 8 of patent, insert -- the tablet dispensing mechanism including a number of tablet chutes and a tablet transfer device for moving at least one tablet from a bottom section of each chute to said one gelatin strip at said feeding location, --.
Line 13, after "strips" insert -- , and said transfer device includes vacuum applying members to lift said tablets from bottom sections of respective chutes and a vacuum source operatively connected to said vacuum applying members as they move from said bottom sections to said feeding location, said tablet transfer being effectuated by the mounting of said vacuum applying members on a vertically and horizontally movable, air cylinder drive frame --.
Line 26, "and a" should be -- for feeding said --.
Line 27, delete "vertically extending".
Line 27, after "which" insert -- are vertically extending and --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*